US006516721B1

(12) United States Patent
Voge

(10) Patent No.: US 6,516,721 B1
(45) Date of Patent: Feb. 11, 2003

(54) INKING UNIT FOR A PRINTING MACHINE AND METHOD FOR SUPPLYING INK TO A PRINTING MACHINE

(75) Inventor: Michael Voge, Malsch (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/470,624

(22) Filed: Dec. 22, 1999

(30) Foreign Application Priority Data

Dec. 22, 1998 (DE) ..... 198 59 436

(51) Int. Cl.[7] ..... B41F 31/02
(52) U.S. Cl. ..... 101/365; 101/366
(58) Field of Search ..... 101/351.8, 365, 101/366, 487, 491, 363, 364; 346/6, 7, 11, 17, 20, 21, 22, 47, 46, 61, 60, 68, 88, 89, 100

(56) References Cited

U.S. PATENT DOCUMENTS

| | | | | | |
|---|---|---|---|---|---|
| 4,007,684 | A | * | 2/1977 | Takano et al. | 101/366 |
| 4,066,014 | A | * | 1/1978 | Van Haaften | 101/157 |
| 4,106,030 | A | * | 8/1978 | Hampton et al. | 347/17 |
| 4,125,845 | A | * | 11/1978 | Stevenson, Jr. | 347/17 |
| 4,332,196 | A | * | 6/1982 | Braun | 101/365 |
| 4,341,156 | A | * | 7/1982 | Kaeppner | 101/141 |
| 4,535,692 | A | | 8/1985 | Schubert | |
| 4,712,172 | A | * | 12/1987 | Kiyohara et al. | 347/47 |
| 4,714,931 | A | * | 12/1987 | Erskine et al. | 347/7 |
| 4,825,228 | A | * | 4/1989 | Glöeckler et al. | 347/7 |
| 4,914,522 | A | * | 4/1990 | Duffield et al. | 347/21 |
| 5,027,706 | A | * | 7/1991 | Niemiro et al. | 101/366 |
| 5,129,320 | A | * | 7/1992 | Fadner | 101/365 |
| 5,367,982 | A | * | 11/1994 | DeMoore et al. | 118/46 |
| 5,407,136 | A | * | 4/1995 | West et al. | 347/47 |
| 5,611,278 | A | * | 3/1997 | Garner et al. | 101/349.1 |
| 5,724,890 | A | * | 3/1998 | Deschner et al. | 101/366 |
| 5,864,351 | A | * | 1/1999 | Silverbrook | 347/17 |
| 5,927,200 | A | * | 7/1999 | Chou et al. | 101/364 |
| 5,967,045 | A | * | 10/1999 | Staiger et al. | 101/366 |
| 6,109,177 | A | * | 8/2000 | Wech et al. | 101/349.1 |
| 6,145,952 | A | * | 11/2000 | Sharma et al. | 347/22 |
| 6,234,599 | B1 | * | 5/2001 | Ishinaga et al. | 347/17 |

FOREIGN PATENT DOCUMENTS

| | | | |
|---|---|---|---|
| DE | 356050 | | 7/1922 |
| DE | 3301909 | C1 | 10/1984 |
| DE | G8530746.7 | | 11/1986 |
| DE | 3545535 | A1 | 7/1987 |
| DE | 4220177 | A1 | 12/1993 |
| DE | 4323933 | A1 | 1/1995 |
| DE | 4327212 | A1 | 2/1995 |
| DE | 19624470 | C2 | 12/1998 |

OTHER PUBLICATIONS

Anonymous: "IFRA–Seminar: Zeitungsrotationen" [IFRA workshop : newspaper rotation], *zeitungstechnik, Jul./Aug. 1996, p. 30.*

German Utility Model G 85 30 746.7, dated Jan. 15, 1987, device for metering ink for offset and relief printing rotary printing presses.

* cited by examiner

*Primary Examiner*—Eugene H. Eickholt
(74) *Attorney, Agent, or Firm*—Laurence A. Greenberg; Ralph E. Locher; Gregory L. Mayback

(57) ABSTRACT

An inking unit for a printing machine includes one or more distributor drums, ink transfer rollers, ink application rollers, an ink reservoir for printing ink and an ink metering device having at least one electrically controllable valve for metering the printing ink. In accordance with the invention, there are provided a high-pressure pumping device for supplying the ink metering device with printing ink at a predetermined high pressure from the ink reservoir, and a heating device for heating the printing ink to a predetermined temperature above room temperature. Moreover, the at least one valve of the ink metering device has a short reaction time and a flow rate with a low dependence upon viscosity. The invention also relates to a method for supplying printing ink to a printing machine.

23 Claims, 7 Drawing Sheets

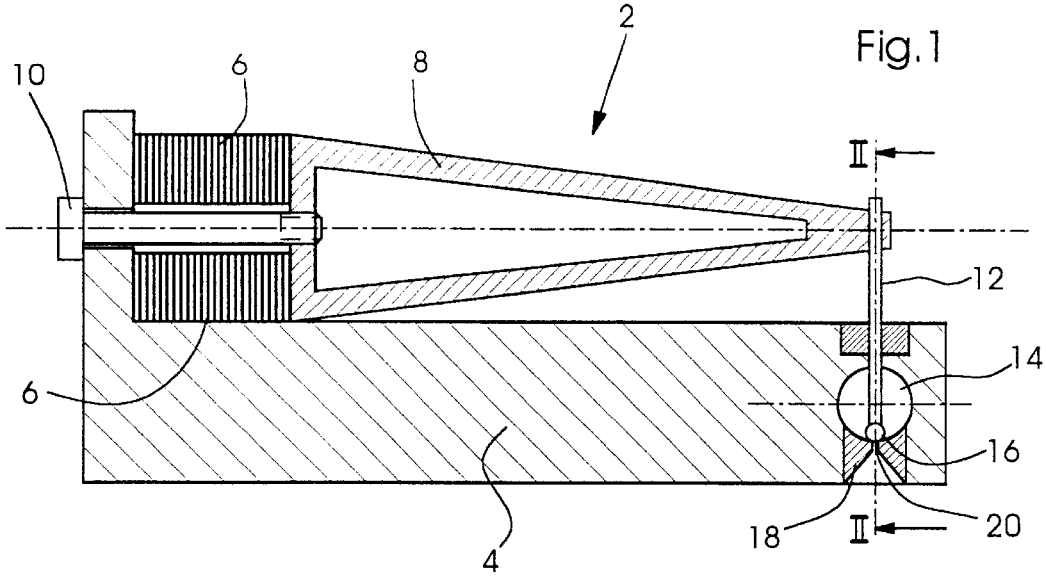
Fig.1
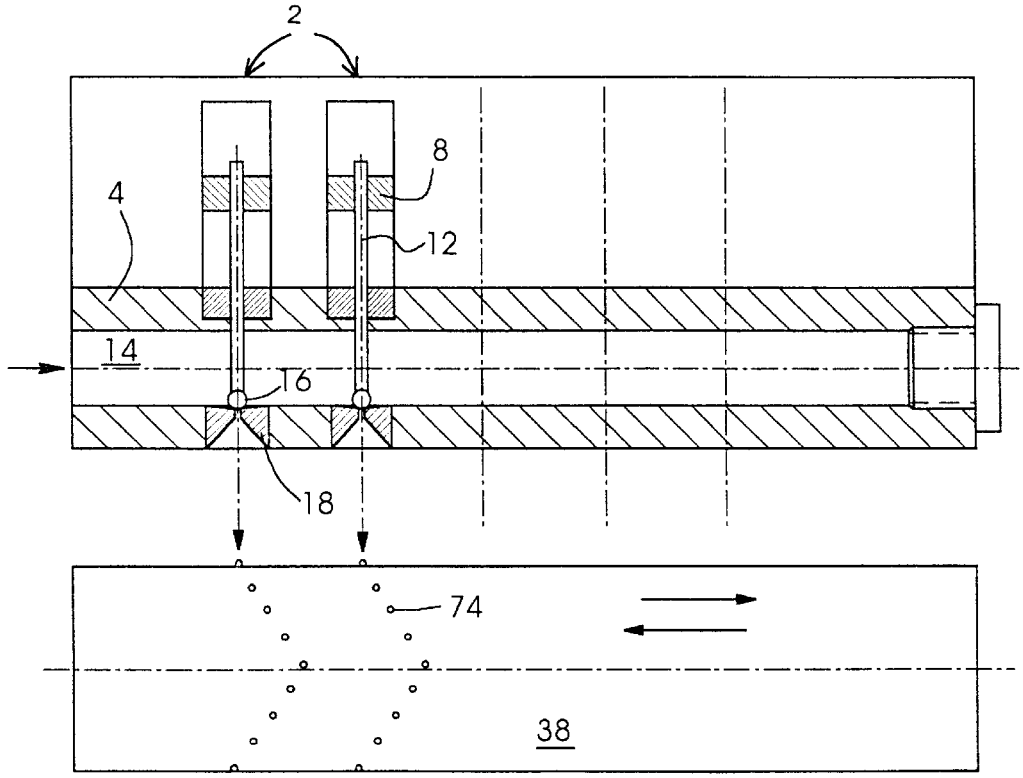
Fig.2
Fig.3

72
74
40
36
38
58
34
48
70
53
50
66
68
52
63
56
54
46
64
62
42
60
44

INKING UNIT FOR A PRINTING MACHINE AND METHOD FOR SUPPLYING INK TO A PRINTING MACHINE

BACKGROUND OF THE INVENTION

Field of the Invention

The invention relates to an inking unit for a printing machine, which includes one or more distributor drums, ink transfer rollers, ink application rollers, an ink reservoir for printing ink and an ink metering device having at least one electrically controllable valve for metering the printing ink. The invention also relates to a method for supplying printing ink to a printing machine.

A conventional inking unit for an offset printing press is shown in FIG. 7. The inking unit includes an ink fountain 122 serving as a reservoir for printing ink 124, an ink fountain roller 126, an ink feed roller 128 and a roller arrangement which, in this conventional embodiment, includes four distributor drums 130*a* to 130*d*, four ink applicator rollers 132, which roll on a plate cylinder 134 of the printing machine, and a number of ink transfer rollers 136. The demand or requirement for the printing ink 124 is set or adjusted zonewise as a function of or in accordance with the printing image by pressing a sprung blade (ink fountain blade) 125 more-or-less strongly against the ink fountain roller 126, and thereby varying the ink quantity that passes through the gap between the ink fountain blade 125 and the ink fountain roller 126. Regulation of the printing ink 124 over the entire width of the ink fountain roller 126 is performed by varying the ink removing stripe that is lifted from the ink fountain roller 126 by the ink feed roller 128 in a rhythmic oscillating movement. The printing ink 124 is repeatedly distributed and divided by the downline arrangement of hard and soft rollers of various diameters, and distributed by an axial movement of the distributor drums 130*a* to 130*d* before it is applied to the plate cylinder 134 by the ink applicator rollers 132.

The aforedescribed arrangement permits only relatively imprecise ink metering which is yet further worsened by wear in the ink metering region, with the result that a large number of rollers are required to achieve the necessary low ink film thickness. The ink feed can be reproduced only with difficulty. Subassemblies such as that formed of an ink fountain, an ink fountain roller and ink feed roller require a relatively large amount of space and have to be cleaned regularly. In order to automate the ink metering, which is normally performed manually, electric actuating and control elements are required in addition to the elements described hereinabove. There is also a need for a squeegee device to remove excessive printing ink. Heretofore known methods for solving these problems call for the use of ink cartridges, for example, as a result of which only the manual ink feed is eliminated, or for the use of low-wear materials for the ink metering region, which likewise only partially solves the described problems.

The journal Zeitungstechnik, July/August 1996, page 30, displays an inking unit of the type described in the introduction hereto, wherein the printing ink is applied to a specifically constructed ink film roller with the aid of a digital ink pumping system which includes a gear pump and solenoid valves which are under pulse-length control. It is true that the ink metering is performed more precisely than with ink fountain systems, but there is a need for a squeegee or doctor blade device for removing excessive ink.

SUMMARY OF THE INVENTION

It is accordingly an object of the invention to provide an inking unit for a printing machine with an ink metering device that permits extremely precise ink metering, the inking unit having a simple and space-saving construction and being derivable from a conventional inking unit by simple structural changes. It is a further object of the invention to provide a method of supplying ink to a printing machine that is an improvement over heretofore known methods of this general type.

With the foregoing and other objects in view, there is provided, in accordance with one aspect of the invention, an inking unit for a printing machine, including at least one distributor drum, ink transfer rollers, ink application rollers, an ink reservoir for printing ink and an ink metering device having at least one electrically controllable valve for metering the printing ink, comprising a high-pressure pumping device for supplying the printing ink metering device with printing ink at a predetermined high pressure from the ink reservoir, and a heating device for heating the printing ink to a predetermined temperature above room temperature, the at least one valve of the ink metering device having a short reaction time and a flow rate with a low dependence upon viscosity.

In accordance with another feature of the invention, the at least one valve includes piezoelectric actuators.

In accordance with a further feature of the invention, the at least one valve includes a spherical sealing element disposed opposite a spherically recessed valve seat wherein an opening having a substantially smaller diameter than that of the spherical sealing element is formed.

In accordance with an added feature of the invention, the printing ink, at room temperature and a low shear rate, has a dynamic viscosity of more than 10 pa s (pascal seconds), the pumping device being capable of producing a pressure in the range of approximately 10 to 100 bar, and the temperature of the printing ink heated by the heating device being in a range of approximately 40° C. to 70° C.

In accordance with an additional feature of the invention, the ink metering device includes a row of nozzles directed onto the surface of one of the distributor drums.

In accordance with yet another feature of the invention, a respective valve is provided for each ink zone, the valve having an outlet connected to at least one nozzle disposed in the respective ink zone.

In accordance with yet a further feature of the invention, the ink reservoir is one of an ink cartridge and a bulk container, respectively.

In accordance with yet an added feature of the invention, the inking unit includes a valve for supplying cleaning liquid for the purpose of cleaning the ink metering device.

In accordance with yet an additional feature of the invention, the ink metering device is provided for the purpose of spraying cleaning liquid onto a distributor drum.

In accordance with another aspect of the invention, there is provided a method for supplying printing ink to a printing machine, the printing ink being metered by at least one electrically controllable valve, which comprises feeding the printing ink to the at least one valve at a predetermined high pressure and at a predetermined temperature above room temperature, the printing ink being metered free of excess in the printing machine in accordance with the demand therefor.

In accordance with another mode, the method of the invention includes providing a printing ink which, at room temperature and a low shear rate, has a dynamic viscosity of more than 10 Pa s, pressurizing the printing ink in the range of approximately 10 to 100 bar, and heating the printing ink to a temperature in the range of approximately 40° to 70° C.

In accordance with a further mode of the method, the at least one valve has a reaction time in the order of magnitude of microseconds, and the method further includes metering the ink by opening and closing the at least one valve under pulse-length control.

In accordance with a concomitant mode, the method of the invention includes spraying the printing ink out of synchronism with the machine time cycle onto a distributor drum of the printing machine so that, with one of each distributor stroke and each distributor revolution, respectively, the printing ink is applied offset temporally relative to the machine time cycle.

Thus, the inking unit according to the invention permits the use of a standard offset printing ink which, at room temperature and a low shear rate, has a dynamic viscosity of more than 10 Pa s, for example 50 to 70 Pa s. By virtue of the fact that the printing ink is fed to the at least one valve at a pressure in the range of approximately 10 to 100 bar, and is heated in the process to a temperature in the range of approximately 40 to 70° C., the viscosity is reduced so far that highly precise ink metering is possible in conjunction with a satisfactorily short reaction time of the valve. By selecting a suitable valve construction, assurance is provided that the flow rate of the valve depends as little as possible upon the viscosity, with the result that the desired ink dosage is virtually uninfluenced by any inhomogeneities in the printing ink or by temperature fluctuations.

The at least one valve is preferably a valve with piezoelectric actuators as adjusting elements, a so-called piezoelectric valve. As described in the published German Patent Document DE-A-4 220 177, for example, such a valve has reaction times of the order of magnitude of microseconds. Consequently, it can be opened and closed many times more quickly than conventional solenoid valves, which have reaction times of several milliseconds. This permits very fine metering of the printing ink, preferably by complete opening and closing of the valve under pulse-length control, or alternatively by regulating the flow rate of a valve, the extent of opening of which is controlled by a fast control loop.

Ink metering by piezoelectric actuators has become known heretofore per se in the technology of inkjet printers. Inkjet printers spray ink of low viscosity, normally directly onto paper, and in one of the conventional techniques, the ink is metered by compressing a small volume of printing ink briefly by a piezoelectric actuator, a droplet of printing ink being sprayed onto a dot. By contrast therewith, in the case of the invention of the instant application, it is possible to use offset printing ink of relatively high viscosity, and the compressed and heated printing ink is already under a sufficiently high pressure for ink spraying, with the result that it need only be metered by the piezoelectric valve.

A preferred valve construction for ink metering which is as independent of viscosity as possible is a valve with a spherical sealing element disposed opposite a spherically recessed valve seat wherein an opening with a substantially smaller diameter than that of the spherical sealing element is formed. The volumetric flow is determined by a nozzle connected downline of the valve. In this regard, this nozzle can have a very short through-flow channel, as a result of which the mode of operation corresponds to that of an orifice.

In a preferred embodiment, the ink metering device includes a row of nozzles which are directed onto the surface of one of the distributor drums. The distributor drum moves reciprocatingly in the machine time cycle along the longitudinal axis thereof, so that the printing ink is distributed laterally. In the case of opening and closing of the at least one valve under pulse-length control, care must be taken that the ink spraying not be performed synchronously with the machine time cycle and the distributor movement, respectively, which would produce an inhomogeneous ink profile. The ink film that is applied can be homogenized, for example, by providing that the instant of ink application be somewhat offset temporally with each distributor stroke or with each distributor revolution, or for example by temporal modulation of the valve control pulses.

The invention is suitable both for conventional offset printing presses (sheet-fed and web-fed machines) with ink zones, and for inking units without zones. In one embodiment for ink zones, there is provided for each ink zone a valve having an outlet that is connected to one or more nozzles which are situated in this ink zone. The more nozzles that are present per ink zone, the more uniform the thickness of the ink film that is applied becomes. If spraying onto a distributor drum is performed with variable control times, as described hereinabove, a sufficiently uniform ink distribution can be achieved with a single nozzle per ink zone. On the other hand, in the case of the use of many nozzles side by side, it is also possible to spray onto a quickly running roller other than a distributor drum.

The ink reservoir can, for example, be an ink cartridge which is located in a pressure vessel and is connected to the at least one valve via a pressure line. The ink is pressurized by pressurizing the interior of the pressure vessel. The required pressure can easily be produced from the compressed air present in a printing plant by a pressure converter. An alternative to supplying ink by cartridges is a supply from a bulk container, for example, supplying ink in a manner well known in the technology via a barrel, in which case no change of cartridge is necessary.

As mentioned, the inking unit according to the invention permits ink metering in a manner that is so precise and uniform that considerably fewer inking rollers suffice than were previously required. Moreover, conventional subassemblies such as ink fountain and fountain roller are dispensed with. No special components are required for the remaining part of the inking unit, but conventional components, in particular conventional inking rollers, can be used. As a result, a conventional inking unit can easily be converted to an inking unit according to the invention.

The highly precise ink metering in accordance with the invention permits the printing ink to be metered in the printing machine in accordance with its requirements free from excess, so that it is possible to dispense with any sort of squeegee or doctor blade device. If, nevertheless, an operation is performed with a given ink excess and a squeegee device is consequently used, the quantity of ink to be removed by squeegee can be considerably smaller.

Other features which are considered as characteristic for the invention are set forth in the appended claims.

Although the invention is illustrated and described herein as an inking unit for a printing machine and a method of supplying ink to a printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

BRIEF DESCRIPTION OF THE DRAWINGS

FIG. 1 is a longitudinal sectional view of a device illustrating the principle of a piezoelectric valve;

FIG. 2 is a cross-sectional view of FIG. 1, taken along the line II—II in the direction of the arrows, and also showing several piezoelectric valves, some represented by a phantom line, arranged side by side in a type of valve strip;

FIG. 3 is a longitudinal view of a distributor drum that is being supplied with printing ink by the piezoelectric valves of FIG. 2;

DESCRIPTION OF THE PREFERRED EMBODIMENTS

Figure 4:
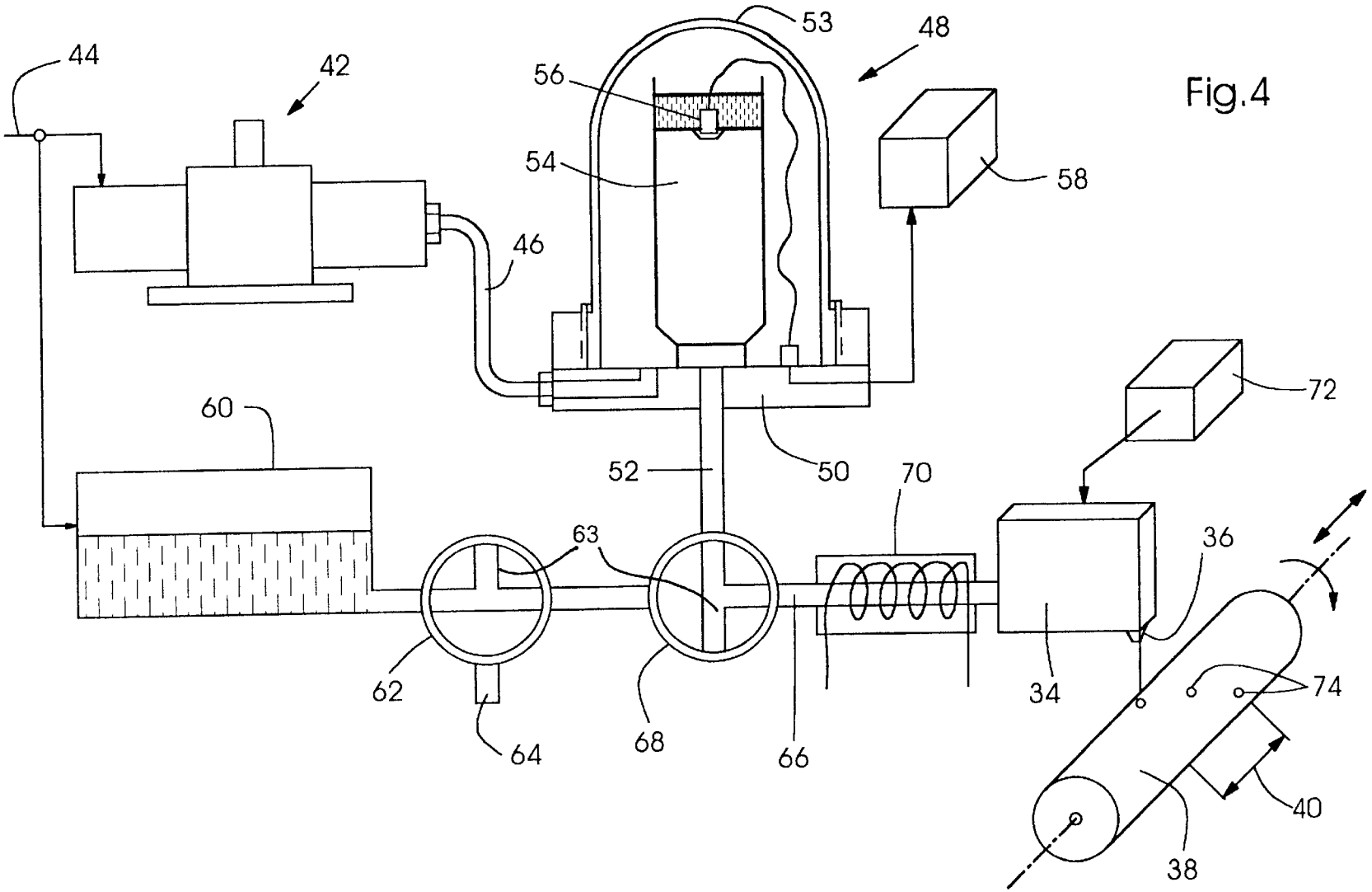
FIG. 4 is a diagrammatic and schematic view of components of an ink supply system for a piezoelectric valve or a plurality of piezoelectric valves forming a valve strip.

Referring now to the figures of the drawings relating to the invention and, more particularly, to FIG. 1 thereof, there is shown therein a piezoelectric valve 2, seen in a longitudinal sectional view thereof, which includes a basic body 4 with an L-shaped cross section. Supported on a shorter limb of the basic body 4 are two piezoelectric actuators 6 which, respectively, include a stack of piezoceramic plates. The piezoelectric actuators 6 extend parallel to a longer limb of the basic body 4 up to an actuating lever 8 that tapers to a point. By a screw 10 extending between and parallel to the two piezoelectric actuators 6, the wider or blunt end of the actuating lever 8 is screwed to the shorter limb of the basic body 4, as a result of which the two piezoelectric actuators 6 are permanently preloaded between the shorter limb of the basic body 4 and the actuating lever 8.

Extending transversely through the pointed end of the actuating lever 8 is an actuating rod 12 that is fastened on the actuating lever 8 by compressive clamping. The actuating rod 12 extends through a matching bore formed in the longer limb of the basic body 4 to a channel 14 formed therein. The actuating rod 12 bears a valve ball 16 at an end thereof projecting into the channel 14. On the side of the valve ball 16 facing away from the actuating rod 12, the basic body 4 is provided with a nozzle 18 formed with an opening 20 having a smaller diameter than that of the valve ball 16. In a closed state, the valve ball 16 seals the opening 20 and, with the valve ball 16 raised, the channel 14 is connected to the outside via the narrow opening 20.

The channel 14 conducts a printing ink that is heated to approximately 40° C. to 70° C. and is under a pressure of, for example, 40 bar. The printing ink is a standard offset printing ink with a viscosity of, for example, 50 to 70 pa s (pascal seconds) at room temperature, which is sharply reduced by the heating. This, as well as the relatively high pressure, permits the printing ink to be finely metered by the piezoelectric valve 2, and subsequently to be sprayed from one or more nozzles.

The piezoelectric valve 2 shown in FIG. 1 operates as follows. When electric voltages of opposite polarity are applied to the two piezoelectric actuators 6, one of the two piezoelectric actuators 6 expands a little, while the other reduces a little. As a result, the actuating lever 8 tilts in the direction of the longer limb of the basic body 4, or away therefrom, depending upon the voltage that is applied. The expansion and contraction, respectively, of the individual piezoelectric actuators 6 is indeed very small, but the result at the tip of the actuating lever 8 is a stroke of the order of magnitude of a few hundred micrometers. The valve ball 16 is moved correspondingly and, depending upon the position of the valve ball 16, the opening 20 in the nozzle 18 is either sealed or, alternatively, held more or less open.

The flow rate of the piezoelectric valve 2 is preferably controlled by alternately opening and closing the valve completely, the length of electric control pulses during which the valve ball 16 assumes a defined opening position being varied. In this regard, by the term "defined" there is meant that the valve 2 is open sufficiently wide for the flow resistance at the exit opening 20 to be distinctly higher than the remaining flow resistance at the sealing seat. The exit opening 20 is configured in accordance with an orifice 18, i.e., the nozzle channel is configured to be short in comparison with the diameter thereof. The orifice 18 is of such construction that the flow rate therethrough is independent of viscosity. If the pressure in the device is then held constant, the flow is exclusively time-dependent. In order to effect a metering that is as independent of viscosity as possible, it is important, furthermore, for the transitions between the states (open/closed) to be very short. The required steep opening and closing sides can be achieved with the piezoelectric actuators 6 which are employed.

In addition to the valve construction (ball valve with nozzle connected downline), steep sides are advantageous when the nozzle 18 is being opened or closed by the valve ball 16. This advantage is fulfilled to the greatest extent by the quick reaction time of the piezoelectric actuators 6.

FIG. 2 shows an arrangement of a plurality of piezoelectric valves 2 side by side in accordance with a sectional view taken along the line II—II in FIG. 1. The piezoelectric valves 2 have a common basic body 4, and are supplied with printing ink via a common channel 14.

As is apparent from FIG. 2 together with FIG. 3, the valve strip of FIG. 2 is arranged along the length thereof close to the surface of a distributor drum 38. As is explained in greater detail in connection with FIG. 4, the nozzles 18 of the piezoelectric valves 2 spray small ink spots or blotches 74 onto the rotating distributor drum 38 during operation. The distributor drum 38 moves in operation along the axis thereof, with the result that the ink spots or blotches 74 are distributed in the form of undulations or wiggles on the distributor drum 38.

As is described additionally hereinbelow, only a few further rollers are required in order to roll out the distributed ink spots or blotches 74 on the distributor drum 38 to form a coherent ink film.

In the arrangement of FIG. 3, a piezoelectric valve 2 is provided for each ink zone, for example, with the result that the printing ink can be finely dosed as a function of the then actual requirement in the respective ink zone.

FIG. 4 shows the components of an ink supply system for a diagrammatically and schematically represented piezoelectric valve 34 which, in this example, includes a single nozzle 36 that is directed onto the surface of a distributor drum 38 of the inking unit. An exemplary embodiment of a piezoelectric valve with a plurality of nozzles is described further hereinbelow.

As indicated by arrows, while the distributor cylinder 38 is rotating, it moves approximately 35 mm reciprocatingly in the axial direction thereof. The result is that, with the nozzle 36, an axial section 40 that is somewhat wider than the width of an ink zone of 32 mm is covered on the distributor drum 38. Further piezoelectric valves 34, respectively, are provided for the other ink zones (not shown in FIG. 4). The ink supply system shown in FIG. 4 supplies not only the one piezoelectric valve 34 represented, but all the piezoelectric valves 34 which are required for the printing width of the printing machine, a valve strip, for example, as shown in FIG. 2.

Via a pressure line 44, a pressure converter 42 receives compressed air at approximately 6 to 8 bar, as is available for operating a printing machine, and produces therefrom compressed air at approximately 40 bar that is fed via a further pressure line 46 to a pressure vessel 48. The pressure vessel 48 includes a base 50, through which the pressure line 46 and an ink outlet line 52 run, and a bell 53 which can be screwed on in a pressure-tight manner. Located inside the pressure vessel 48 is an ink cartridge 54 that is connected to the ink outlet line 52. On the upper side of the ink cartridge 54, the latter is open or sealed with a movable plug, with the result that the pressure inside the pressure vessel 48 drives the printing ink from the ink cartridge 54 into the ink outlet line 52. The filling level of the printing ink inside the ink cartridge 54 is monitored by a level sensor 56 that is connected via a cable to an electronic sensor system 58 which outputs a warning signal to a non-illustrated central printing machine control when the contents of the ink cartridge 54 tend to come to an end.

Instead of the pressurized ink cartridge 54 as in FIG. 4, which must be changed from time to time, it is possible as an alternative to use a continuous ink supply from a bulk container, for example, a barrel, through the intermediary of a barrel pump. Suitable barrel pumps are commercially available in various forms.

The operating compressed air of the printing machine is also fed to a tank 60 containing a cleaning liquid, in order to pressurize the cleaning liquid. Alternatively, instead of the tank 60, use may be made of a cartridge with cleaning liquid that is pressurized. An outlet line from the tank 60 can be connected optionally via a three-way valve 62 to a line section 63 or to an outlet 64. An inlet line 66 of the piezoelectric valve 34 can be connected via a further three-way valve 68 optionally to the ink outlet line 52 or to the line section 63. During a printing operation, the three-way valve 08 is located in the position illustrated, wherein the inlet line 66 of the piezoelectric valve 34 is connected to the ink outlet line 52. For cleaning purposes, the three-way valves 62 and 68 are set so that the cleaning liquid can flow through the piezoelectric valve 34 and/or through the valve strip.

The cleaning of the piezoelectric valve 34 and the piezoelectric valves 94 (note FIG. 6), respectively, which is necessary when changing ink, can also be used advantageously to perform a spraying of the inking rollers with cleaning liquid. It is therefore possible to eliminate the spraying device for cleaning liquid that was previously required in order to clean the inking unit. The corresponding advantages reside in the fact that, when simultaneously using the piezoelectric valve 34 for metering printing ink and cleaning liquid, less costs and less overall space are required.

In the case of washing operations which are required when an ink change is simultaneously being performed, the cleaning of the piezoelectric valves 34 automatically entails spraying the distributor drum 38 with cleaning liquid. The cleaning liquid is then distributed throughout the inking unit via this distributor drum 38. In order to keep the additional consumption of printing ink low in the case of washing operations which are performed when no ink change is involved, it is advantageous to put the three-way valve 68 near the piezoelectric valve 34. In other cases, the printing ink can be sucked back in advance out of the channel 14 and line system 66 and into the ink cartridge 54 or to an appropriate reservoir. Cleaning of the piezoelectric valve 34 begins thereafter, followed by the cleaning of the entire inking unit.

The inlet line 66 of the piezoelectric valve 34 passes through a diagrammatically represented preheater 70 that heats the pressurized printing ink from the ink cartridge 54 to a temperature of up to 65° C. The piezoelectric valve 34 includes a non-illustrated heater that maintains it at the same temperature so that the printing ink therein does not cool down.

The piezoelectric valve 34 is driven by square-wave pulses via a valve control unit 72 that is connected to the central printing machine control, the pulses opening the piezoelectric valve 34 for the duration of each pulse and, otherwise being closed for the remaining time. The short reaction time of the piezoelectric valve 34 permits the pulses to follow one another very quickly, for example, at a frequency of 3 kHz, and the printing ink to be applied to the distributor drum 38 in a correspondingly finely distributed manner.

Because the time that the individual square-wave pulses are on is very short, the nozzle 36 of the piezoelectric valve 34 sprays tiny ink spots or blotches 74 onto the rotating distributor drum 38, as indicated diagrammatically in FIG. 4, while a long square-wave pulse produces a more-or-less long line on the distributor drum 38. Because of the axial movement of the distributor drum 38, the ink spots or blotches 74 are distributed not only in the radial direction, but also in the axial direction on the distributor drum 38.

If the piezoelectric valve 34 were driven synchronously with the machine time cycle, the pattern of the ink spots or blotches 74 applied to the distributor drum 38 would be repeated after one or more revolutions, resulting in a non-uniform ink profile. It is therefore advantageous when the ink application is offset temporally with respect to the machine time cycle several times during a distributor drum revolution, by suitable software control, for example, by a temporal modulation of the pulse train forwards and backwards, it thereby being possible to achieve zonal homogenization of the printing ink that is applied. A further possibility for applying the ink as uniformly as possible is for the quantity of ink required per revolution of the inking roller to be sprayed on in many small ink spots or blotches instead of a few large ones. It is possible, in this way, to achieve a very uniform application of ink to the distributor drum 38 with only one nozzle 36 per ink zone. Such an homogenization of the ink application can also be useful in the case wherein a multiple nozzle is used per piezoelectric valve 34, with a sufficiently large number of nozzles it also being possible to manage without specifically varying the control times with reference to the machine time cycle.

The quantity of printing ink applied to the distributor drum is set by setting the duration of the square-wave pulses during which the piezoelectric valve 34 is open and the nozzle 36 sprays printing ink onto the distributor drum 38. Alternatively, the piezoelectric valve 34 can be regulated so that, at any instant, it assumes the position of the opening corresponding to the then current requirement. However, using the ink feed under pulse-length control described hereinabove, it is particularly easy to achieve an extremely accurately defined and precisely reproducible ink metering over a very large metering range from a minimum ink quantity to a maximum quantity.

Figure 5:
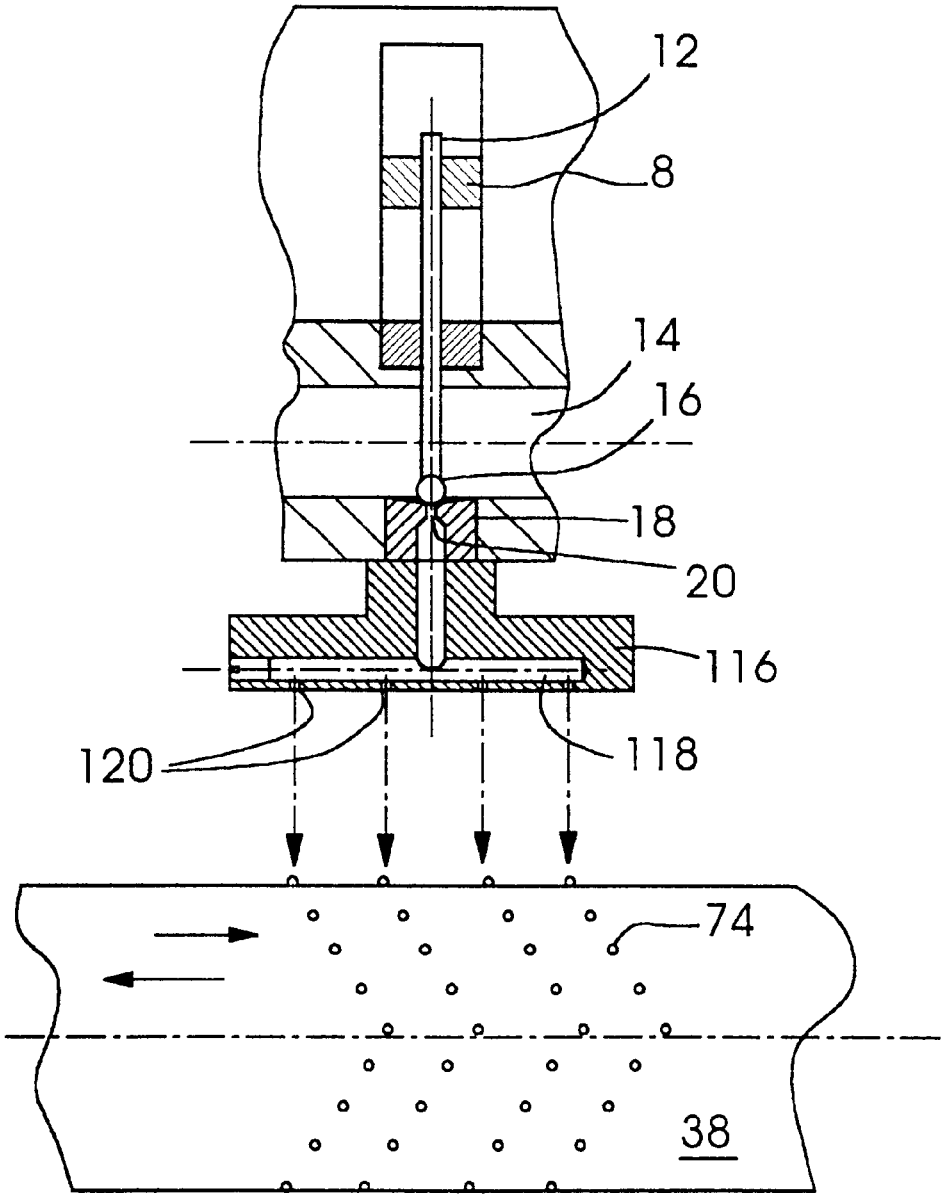
FIG. 5 is a view similar to that of FIG. 3 of a piezoelectric valve with a multiple nozzle connected upline thereto.

FIG. 5 is a view, similar to those in FIGS. 2 and 3, of a piezoelectric valve 2 that does not spray the printing ink directly onto the distributor drum 38, but has a distributor structure 116 that can, for example, be a unipartite or multipartite injection-molded plastic part. The distributor structure 116 includes a channel 118 in the form of an inverted "T" having a middle part connected to the opening 20 in the nozzle 18 of the piezoelectric valve 2, and having a transversely extending part that includes four nozzles 120 arranged in a row. The multiple nozzle formed thereby permits a single piezoelectric valve 2 to spread finely distributed printing ink over the width of an entire ink zone, as indicated by the ink spots or blotches 74. In the case of an inking unit without zones and with or without a squeegee or doctor blade device, such a multiple nozzle can even extend over the entire printing width, so that a single piezoelectric valve suffices.

Figure 6A:
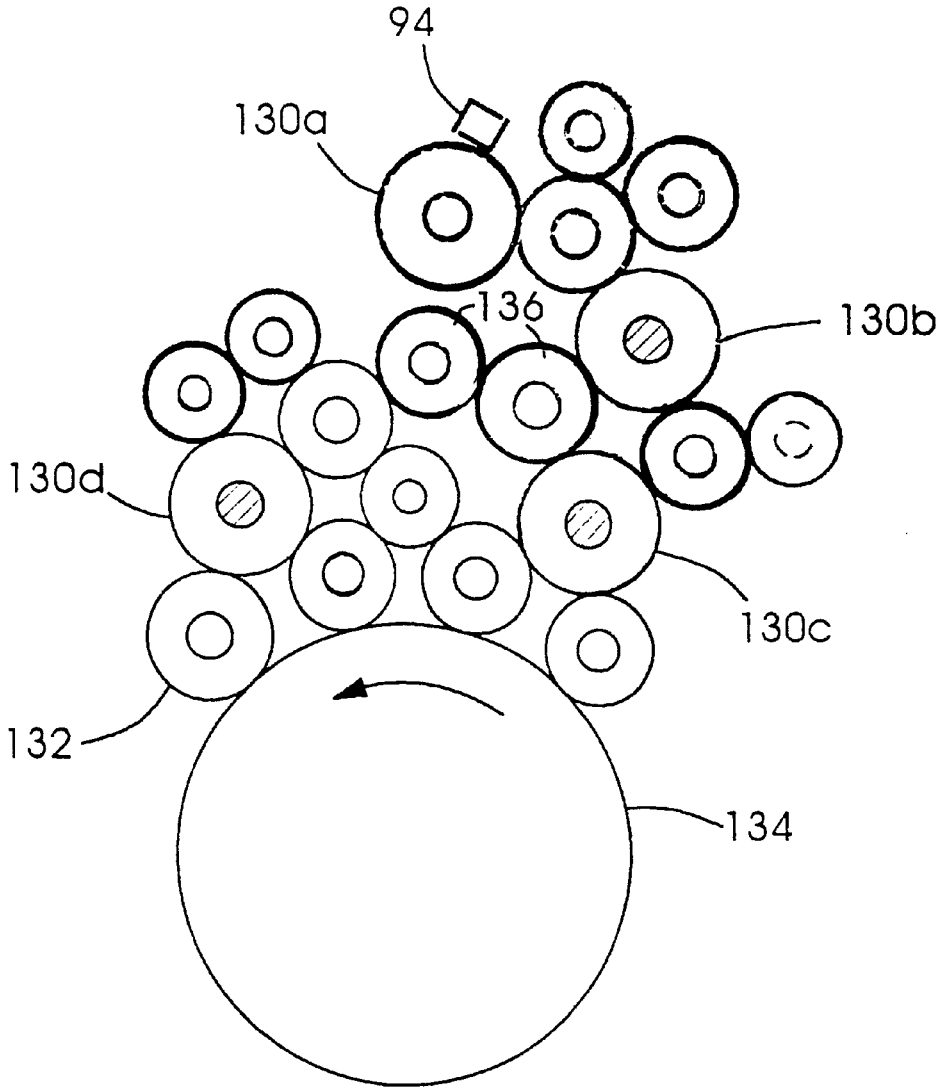
FIGS. 6A, 6B, and 6C are fragmentary diagrammatic side elevational view of a printing unit showing possible arrangements of piezoelectric valves therein.
Figure 6B:
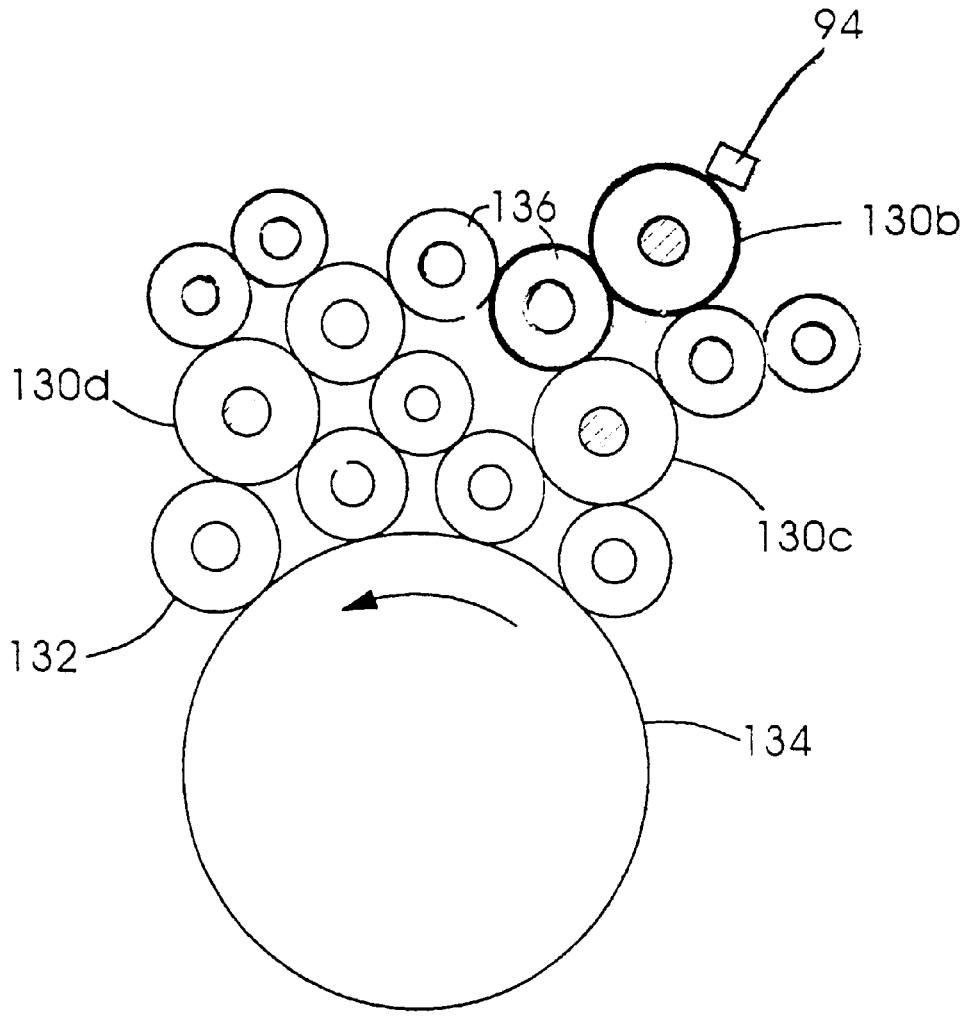
Figure 6C:
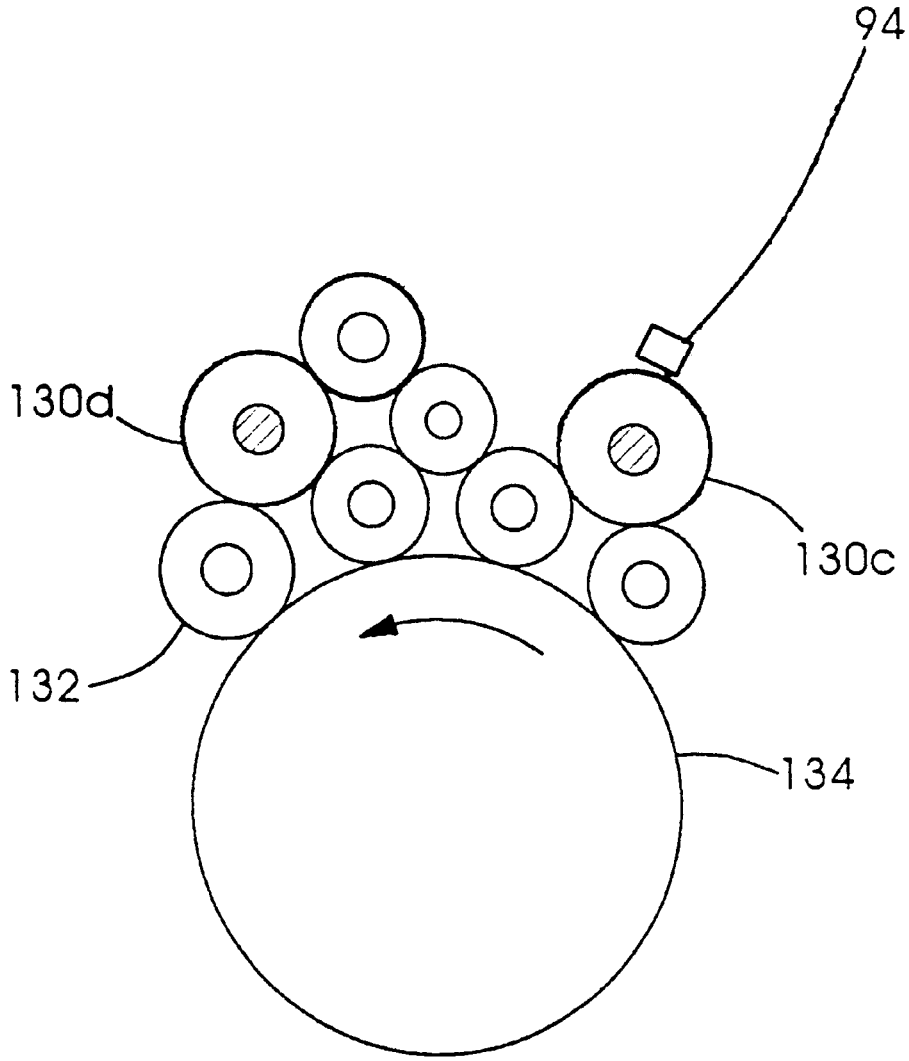
Figure 7:
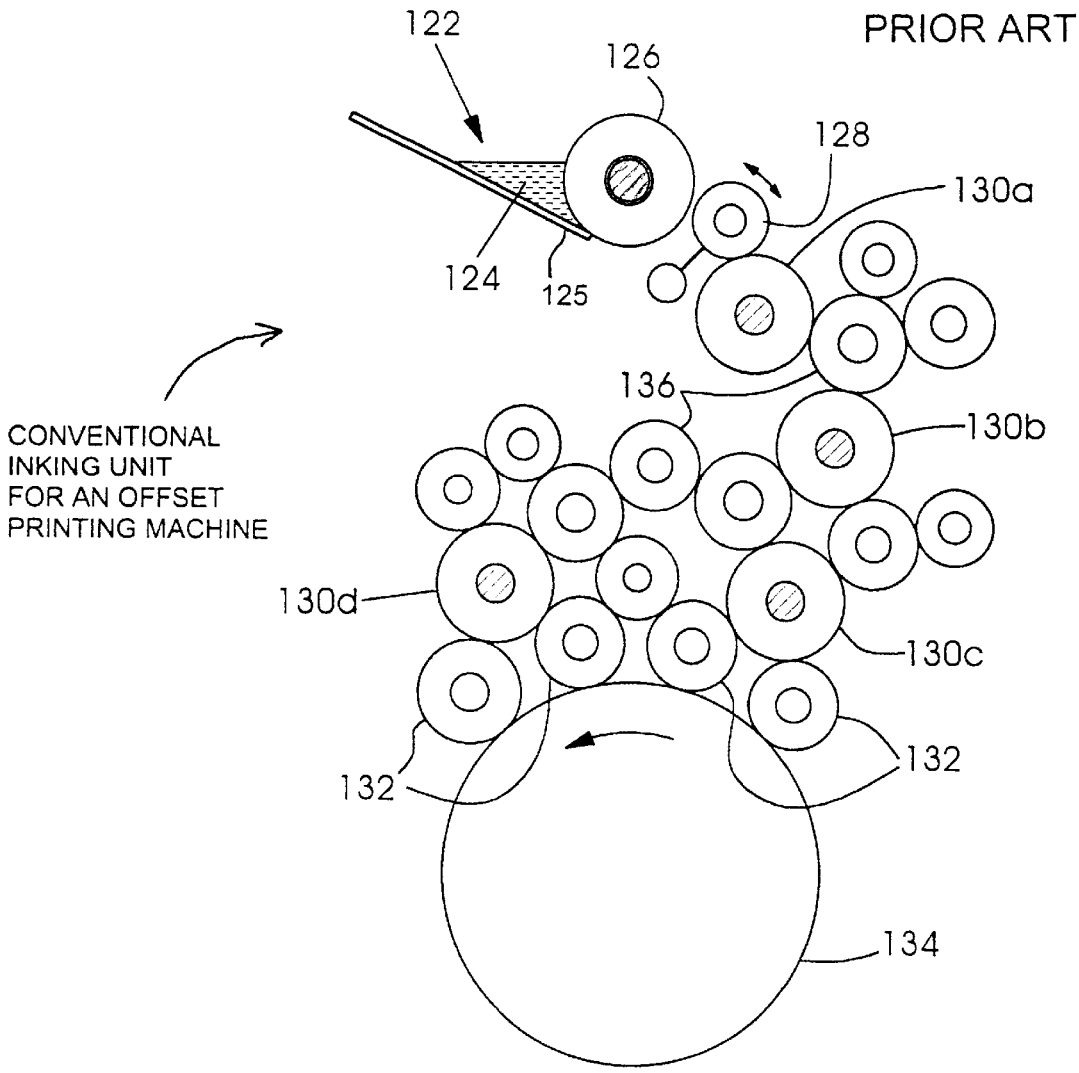
Fig.7 PRIOR ART
FIG. 7 is a fragmentary diagrammatic side elevational view of a conventional inking unit for an offset printing machine, as described hereinbefore on page 1.

FIGS. 6A, 6B, and 6C show an inking unit that is derived, as in FIG. 7, from a conventional inking unit, in that the ink fountain 122, the ink fountain roller 126 and the ink feed roller 128 have been removed. In a first exemplary embodiment, as shown in FIG. 6A, a piezoelectric valve 94 or an appropriate valve strip with a plurality of piezoelectric valves 94 are arranged so that the distributor cylinder 130*a* is sprayed. In a second exemplary embodiment, as shown in FIG. 6B, the piezoelectric valves 94 are arranged not on the distributor cylinder 130*a* but on the distributor cylinder 130*b*. It is possible to dispense with even more rollers or cylinders, as shown in FIG. 6C, if appropriately fine metering is provided by, for example, spraying onto the distributor cylinder 130*c* or onto a different, arbitrary point, as a result of which the inking unit is advantageously shortened and becomes a so-called short inking unit.

It is thus evident that for practical use it is possible to produce an inking unit with very many fewer moving parts than a conventional inking unit, which moreover enables the ink to be metered uniformly and extremely precisely. As a result, it is possible furthermore to meter the printing ink free from excess, and thus to dispense with a squeegee or doctor blade device such as is required with customary offset inking units for sheet-fed or web-fed machines. Because there is no mechanical wear in the ink metering region, the ink metering can be reproduced very well. Furthermore, the cleaning of the inking unit is simplified.

I claim:

1. In combination with a printing press, an inking unit comprising:

an ink metering device having at least one electrically controllable valve with a short reaction time for precisely metering the printing ink and with an ink flow rate substantially independent of viscosity of the printing ink;

a high-pressure pumping device for supplying the printing ink metering device with printing ink at a predetermined high pressure; and a heating device for heating the printing ink to a predetermined temperature above room temperature.

2. The inking unit according to claim 1, wherein the at least one valve includes piezoelectric actuators.

3. The inking unit according to claim 1, wherein the at least one valve includes a spherical sealing element disposed opposite a spherically recessed valve seat wherein an opening having a substantially smaller diameter than that of said spherical sealing element is formed.

4. The inking unit according to claim 1, wherein the printing ink, at room temperature and a low shear rate, has a dynamic viscosity of more than 10 pascal seconds, said pumping device being capable of producing a pressure in the range of approximately 10 to 100 bar, and the temperature of the printing ink heated by the heating device being in a range of approximately 40° C. to 70° C.

5. The inking unit according to claim 1, wherein said ink metering device includes a row of nozzles directed onto the surface of a distributor drum.

6. The inking unit according to claim 1, further comprises at least one ink zone, and a respective valve for each ink zone, said respective valve having an outlet connected to said at least one nozzle disposed in the respective ink zone.

7. The inking unit according to claim 1, further comprising an ink reservoir for supplying the printing ink metering device with printing ink via said high-pressure pumping device.

8. The inking unit according to claim 1, including a valve for supplying cleaning liquid for cleaning the ink metering device.

9. The inking unit according to claim 8, wherein the ink metering device is provided for spraying cleaning liquid onto a distributor drum through the at least one valve of the ink metering device.

10. The inking unit according to claim 7, wherein said ink reservoir is an ink cartridge or a bulk container.

11. A method for supplying printing ink to a printing press, which comprises:

feeding printing ink to at least one valve at a predetermined high pressure and at a predetermined temperature above room temperature; and metering the printing ink by at least one electrically controllable valve in accordance with the demand of the printing press free of excessive metering of ink.

12. The method according to claim 11, which includes providing a printing ink which, at room temperature and a low shear rate, has a dynamic viscosity of more than 10 pascal seconds, pressurizing the printing ink in the range of approximately 10 to 100 bar, and heating the printing ink to a temperature in the range of approximately 40° to 70° C.

13. The method according to claim 11, wherein the at least one valve has a reaction time in the order of magnitude of microseconds, and which includes metering the ink by opening and closing the at least one valve under pulse-length control.

14. The method according to claim 11, wherein the printing press has a machine time cycle with a distributor stroke, a distributor revolution, and a distributor drum having a stroke and being revolvable, and the method further comprises the step of spraying the printing ink out of synchronism with the machine time cycle onto the distributor drum of the printing press so that, with one of each distributor stroke and each distributor revolution, respectively, the printing ink is applied offset temporally relative to the machine time cycle.

15. The method according to claim 11, which further comprises performing the step of metering the printing ink using a piezoelectric actuator.

16. In combination with a printing press, an inking unit comprising:

at least one electrically controllable valve with a short reaction time;

a high-pressure pumping device for supplying the printing ink to the valve at a predetermined high pressure;

a heating device for heating the printing ink to a predetermined temperature above room temperature;

said at least one valve, said high-pressure pumping device, and said heating device cooperating for precisely metering and uniformly spraying printing ink substantially independently of the viscosity of the printing ink.

17. An inking unit for a printing machine, comprising:

at least one electrically controllable valve with a short reaction time;

a high-pressure pumping device for pressurizing a printing ink in the range of approximately 10 to 100 bars and supplying the printing ink to the valve at a predetermined high pressure; and a heating device for heating the printing ink to a temperature in the range of approximately 40° to 70° C.;

said at least one valve, said high-pressure pumping device, and said heating device co-operating for precisely metering and uniformly spraying the printing ink substantially independently of the viscosity of the printing ink.

18. The inking unit according to claim 17, wherein the at least one valve includes piezoelectric actuators.

19. The inking unit according to claim 17, wherein the at least one valve includes a spherical sealing element disposed opposite a spherically recessed valve seat, forming an opening having a substantially smaller diameter than that of said spherical sealing element.

20. A method for supplying printing ink to a printing machine, which comprises:

feeding printing ink to at least one valve at a pressure in the range of approximately 10 to 100 bar and at a temperature in the range of approximately 40° to 70° C.; and metering the printing ink by at least one electrically controllable valve in accordance with the demand of the printing machine free of excessive metering of ink.

21. The method according to claim 20, wherein the at least one valve has a reaction time in the order of magnitude of microseconds, and which further comprises metering the ink by opening and closing the at least one valve under pulse-length control.

22. The method according to claim 20, wherein the printing machine has a machine time cycle with a distributor stroke, a distributor revolution, and a distributor drum having a stroke and being revolvable, and the method further comprises the step of spraying the printing ink out of synchronism with the machine time cycle onto the distributor drum of the printing machine so that, with one of each distributor stroke and each distributor revolution, respectively, the printing ink is applied offset temporally relative to the machine time cycle.

23. The method according to claim 20, which further comprises performing the step of metering the printing ink using a piezoelectric actuator.

* * * * *